US006119269A

United States Patent [19]

Imler et al.

[11] Patent Number: 6,119,269

[45] Date of Patent: Sep. 19, 2000

[54] FISHING VEST WITH REMOVABLE STORAGE CONTAINER SYSTEM

[76] Inventors: Jack Imler, 8730 El Paso Pl., Anchorage, Ak. 99515; Wilson Leroy Reece, Box 92191, Anchorage, Ak. 99509

[21] Appl. No.: 09/405,272

[22] Filed: Sep. 23, 1999

[51] Int. Cl.[7] ..... A41D 1/04

[52] U.S. Cl. ..... 2/94; 2/102; 2/247

[58] Field of Search ..... 2/94, 102, 247, 2/69, 249, 85, 250, 253, 93, 108; 224/103, 200, 901; 43/54.1

[56] References Cited

U.S. PATENT DOCUMENTS

| | | | |
|---|---|---|---|
| 2,717,391 | 9/1955 | Bracken | 2/94 |
| 4,033,066 | 7/1977 | Morcom | 43/54.1 |
| 4,637,075 | 1/1987 | Ingrisano et al. | 2/94 |
| 4,827,658 | 5/1989 | Wolniak | 43/54.1 |
| 5,063,614 | 11/1991 | McSheffery | 2/94 |
| 5,195,187 | 3/1993 | Yang | 2/102 |
| 5,247,707 | 9/1993 | Parker et al. | 2/102 |
| 5,526,535 | 6/1996 | Dobrenski | 2/94 |
| 5,651,141 | 7/1997 | Scheider | 2/94 |
| 5,829,060 | 11/1998 | Falk et al. | 2/94 |
| 5,852,828 | 12/1998 | Foster | 2/94 |
| 5,913,409 | 6/1999 | Test | 2/102 |
| 5,994,338 | 3/1999 | Golde | 2/247 |

*Primary Examiner*—John J. Calvert
*Assistant Examiner*—Tejash Patel
*Attorney, Agent, or Firm*—Michael J. Tavella

[57] ABSTRACT

A fishing vest and storage system that has great flexibility for the user. The vest has two large that hold containers (or slips). The slips have a number of adjustable sections within them to hold lures, weights, hooks and other gear as desired. The slips have hinged covers for access. The user can load the vest with one or two of these slips for fishing. Once on the water, the user can remove a slip from the pocket and change lures or otherwise make adjustments as desired. Once completed, the slip is closed and returned to the pocket. The vest also has a rod holder loop near the bottom of the vest. A storage container holds the slips when not in use. The container holds the slips and other supplies.

20 Claims, 6 Drawing Sheets

FISHING VEST WITH REMOVABLE STORAGE CONTAINER SYSTEM

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to fishing vests and particularly to fishing vests with removable storage container.

2. Description of Related Art

Fishing is one of oldest pastimes for people. Over the centuries, equipment has been developed for virtually every type of fishing from fresh water, to salt water to fly fishing and so on. The equipment often varies from one type of fishing to the next. Fly fishing uses lures that are completely different from those used in salt water for example. Many fisherpersons like to fish in more than one style. Thus, they have many different lures and equipment suited to these different types of fishing. To store these supplies, tackle boxes have been developed. Some of these tackle boxes are quite large and have numerous drawers, sections and even removable cases to hole the myriad of lures and supplies—as well as tools and implements needed for fishing. Because people engage in different types of fishing, they often have more than one tackle box. Although this makes life considerable easier, it still requires the person to carry a heavy box full of equipment to the fishing site. For boat fishing, this is not a problem. However, for those who prefer in steam fishing or lake fishing, it is impossible to carry the tackle box beyond the shore. Thus, such people are limited in the supplies they can carry. For major tackle changes, they are forced to go to shore and make the changes at the tackle box. This reduces the time for fishing and can be cumbersome if the equipment is some distance from the desired fishing site. For those people who like to fish the backcountry, carrying their gear and a tackle box is almost impossible. For these people, only a select amount of equipment can be taken and if that gear is lost, the fishing is over.

BRIEF SUMMARY OF THE INVENTION

The instant invention overcomes these problems. It has three integral parts: a fishing vest, multiple storage containers (or slips) and storage container. The three components taken together are a system that gives great flexibility to the user. The vest has two large pockets at the bottom of the front for storing tools and other equipment. Two hand warmer pockets are also provided. The right side of the vest includes a vertical rod holding system that uses a VELCRO strap to hold a rod shaft. This strap is located about breast high in the vest. A rod heel receptacle is suspended from the bottom of the right side of the vest to hold the butt of a rod. Located in the lower back of the vest is a large pocket for additional storage. Above the large pockets are two larger pockets that run lengthwise down the front of the vest (one on each side). These two long pockets hold containers (or slips).

The slips are the second component of the system. The slips have a number of adjustable sections within them that form compartments to hold lures, weights, hooks and other gear as desired. The slips have hinged covers for easy access to the slips without fear of losing the lids. The user can load the vest with one or two of these slips for fishing. Once on the water, the user can remove a slip from the pocket and change lures or otherwise make adjustments as desired. Once completed, the slip is closed and returned to the pocket. Because two slips are carried, a considerable variety of equipment can be loaded in the vest, ensuring the user with a good supply of gear. There are two types of slips. Both are the same size. The "small" slip has small partitions on one side and a full-length partition on the other side. It also has two doors to allow access from both sides. The "large" slip has one door and larger partitions.

The third component of the system is a storage container for the slips. The container holds the slips and other supplies. The container has an open slotted box that holds slips upright on two sides. Below the box is a large pullout drawer to store miscellaneous supplies and small tools. The cover is double hinged to fit over the top of the container. It also fits over the front side and extends down to the bottom of the drawer. When closed, the cover keeps the drawer firmly shut.

This storage container allows a user to load slips with whatever lures and equipment desired. All the slips are then carried in the container. The container is carried to the field by the user in a vehicle. On site, the user can then select the slips that contain the particular equipment for the type of fishing desired. If conditions change, or the user desires to try different gear or even a different style of fishing, all one has to do is replace the previously chosen slips with new slips. This system, therefore, provides the user with a great deal of flexibility that is carried in a handy carrying case.

It is an object of the invention to produce fishing vest with tackle-carrying storage compartments.

It is another object of this invention to produce a fishing vest with removable and interchangeable tackle-carrying compartments.

It is yet another object of this invention to produce a storage system for organizing and carrying the interchangeable tackle-carrying storage compartments.

It is yet a further object of this invention to produce fishing vest having an integral rod carrier for holding a rod while changing tackle or doing other tasks.

DETAILED DESCRIPTION OF THE INVENTION

Figure 1:
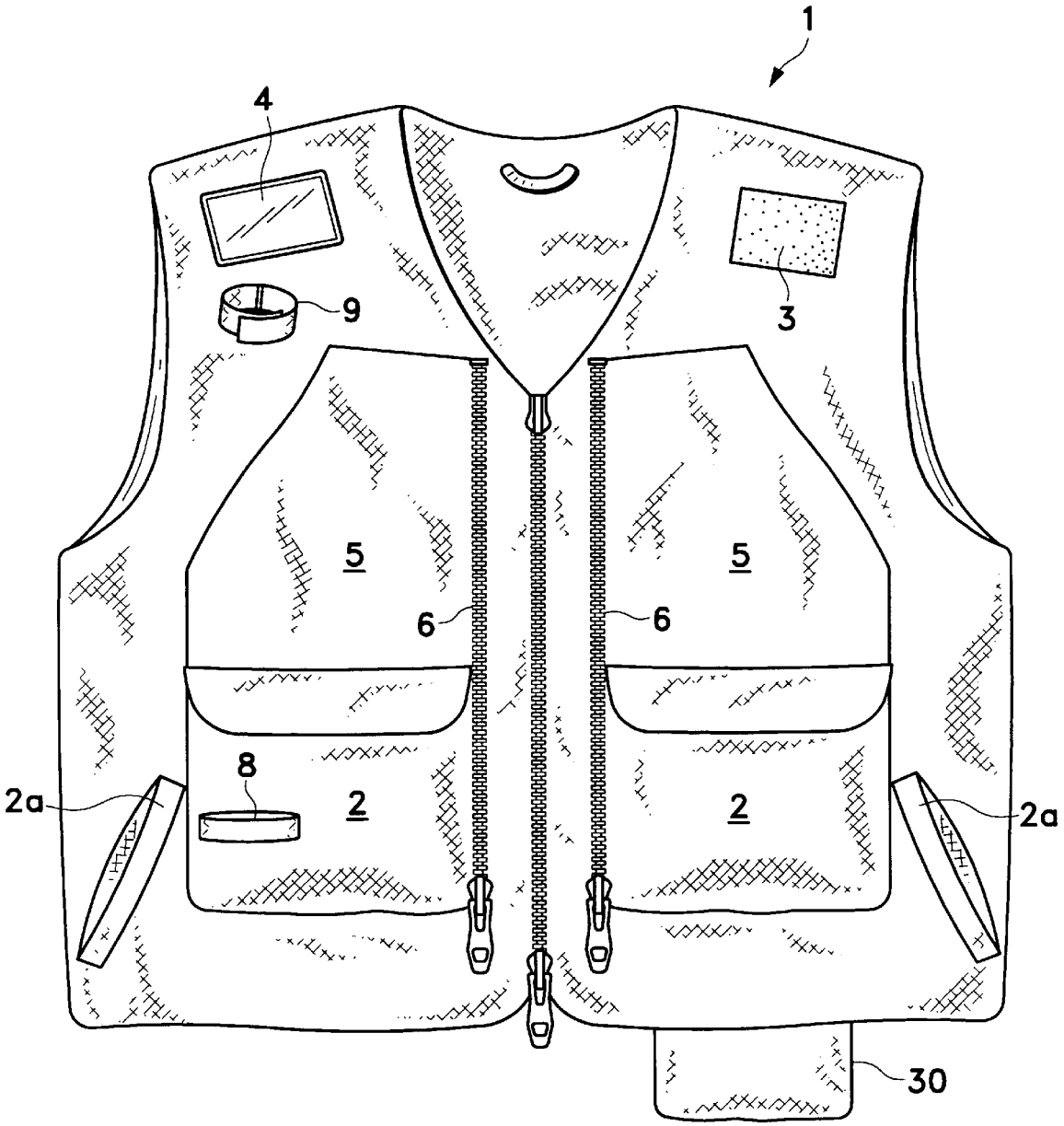
FIG. 1 is a front view of the new fishing vest.

Referring now to the drawing figures and particularly to FIG. 1, the front view of the fishing vest 1 is shown. The vest has two storage pockets 2 at the bottom of the vest as shown. These pockets, in the preferred embodiment, are zippered. However, the can be left open or covered with flaps. These pockets are used for storage of small tools and other supplies. In the preferred embodiment, the backs of these pockets 2*a* are formed as hand warmer pockets.

Above these pockets are items found on many fishing vests. A small square of sheepskin 3 is used to hold flies. A pocket 4 is provided to display fishing licenses. On each side of the vest are two large pockets 5 as shown. The tops of the pockets 5 are slanted as shown. Full-length zippers 6 are placed along the inside edge of the pockets, near the center of the vest as shown. These pockets 5 are used to carry two containers, also called slips 10. The slips are shown in FIGS. 2–6. Two types of slips 10*a* and 10*b* are used. However, both slips 10 have the same external dimensions. These slips can then fit into the pockets, one on each side, of the vest. As discussed in more detail below, these slips 10 can be loaded with various types of lures and other tackle. Once loaded, the user than has a complete set of supplies needed for fishing at any particular location.

FIG. 1 also shows that the vest also has a rod holder. The rod holder has two parts. The first is lower loop 8 that is attached to the front of the pocket 2 as shown. A loop of material 9 is placed near the top of the vest, above, and in line with, the lower loop 8. In the preferred embodiment, the loop 9 is made of a hook and loop type fastener, such as VELCRO. The loop 9 secures the shaft of the rod to the vest. In use, the user places the rod bottom into the loop 8 until the reel catches on the loop 8. Then the user secures the upper portion of the rod, using loop 9. Once secured, the rod can be released, leaving both or the user's hands free to change tackle or do other things as needed. At the back of the vest, a large pouch 30 may be added for additional storage.

When using the vest, a user can change tackle by pulling out a desired slip from one of the pockets 5. The user then opens the lid, removes whatever lure the user desires, and replaces that lure with the lure already used. The user closes the slip 10, replaces it in the vest, secures the lure to the line and is again ready to fish.

As mentioned above, there are two types of slips 10*a,* and 10*b* used in the preferred embodiment. The two types refer to the internal configuration of the slips. These slips are shown in FIGS. 3, 4 5 and 6. As discussed before, both slips have the same external dimensions so they can fit in the vest pockets. Both slips 10*a,* and 10*b* have an overall rectangular shape as shown. One corner of the slips is cut at a 45° angle. This enables the slip to fully fit in the vest pocket 5.

Figure 2:
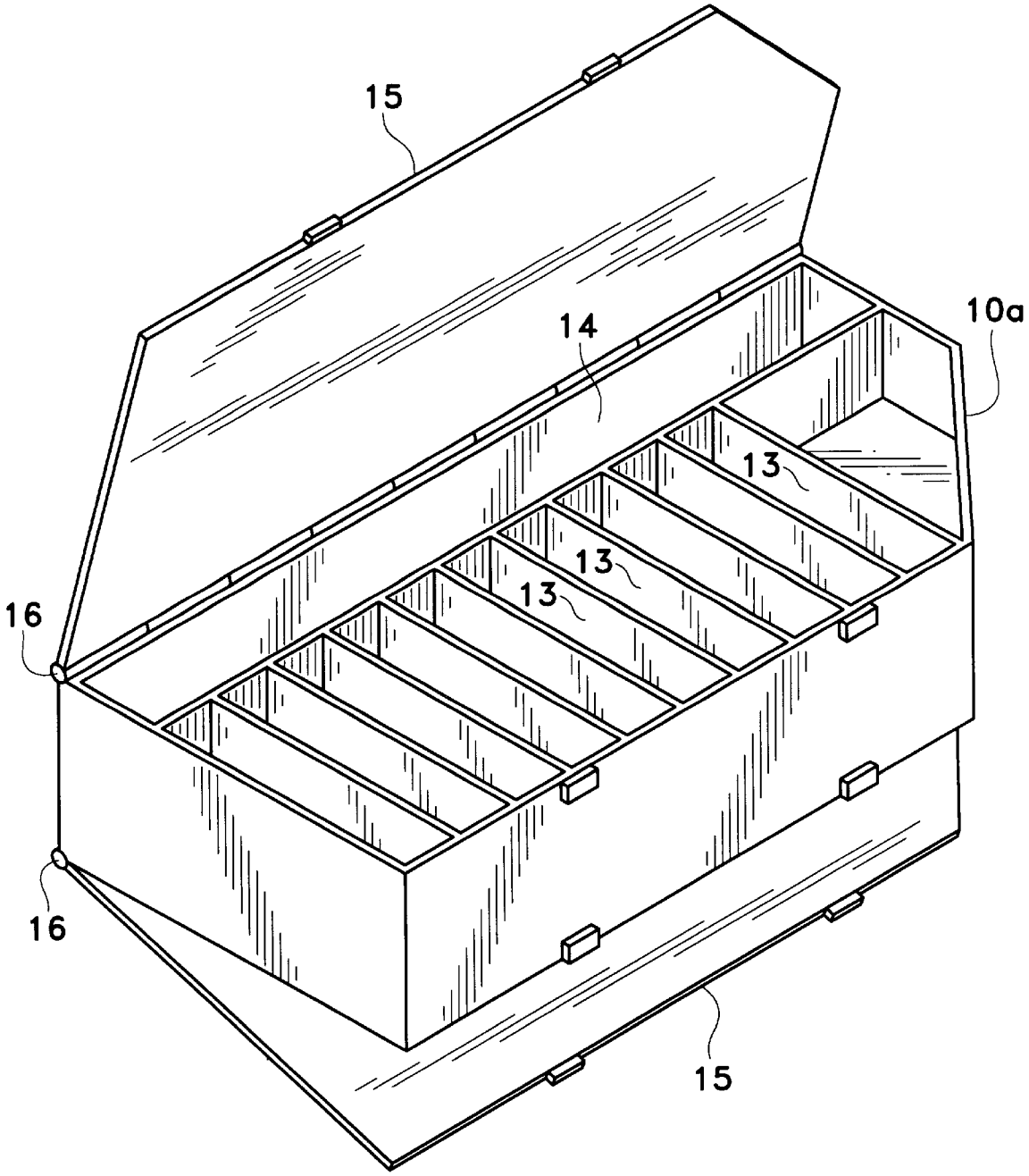
FIG. 2 is a perspective view of a first type of storage slip.
Figure 3:
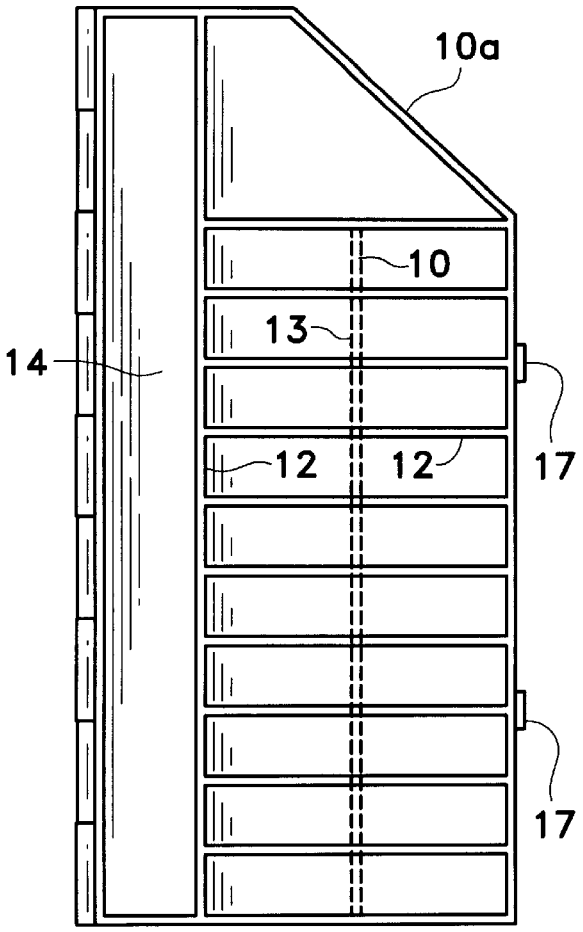
FIG. 3 is a top view of the first storage slip.
Figure 4:
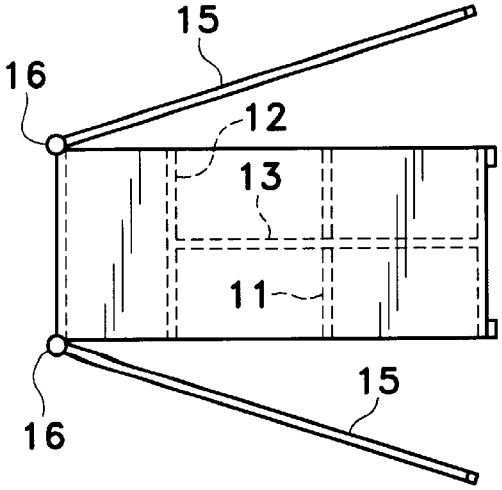
FIG. 4 is an end view of the first type of storage slip, showing the doors open.

Slip 10*a* is shown in FIGS. 2–4. As shown in the figures, this slip has a number of partitions that fit into a framework. Within the slip is a center partition 11. This partition then receives a number of partitions 12 to form a number of compartments. The slip 10*a* of FIG. 3 has a number of small partitions 12 and one long partition 12 placed as shown. This slip 10*a* has two doors 15 as shown. The doors 15 are attached to the slip using hinges 16 or similar fasteners. Latches 17 are used to secure the doors to the case. A center divider 13 divides the slip into front and back compartments as shown in FIG. 4.

Figure 5:
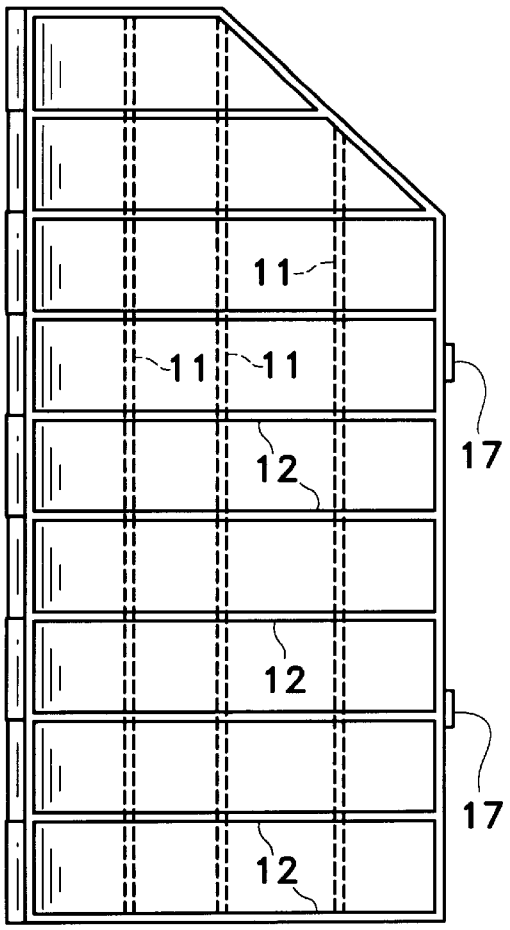
FIG. 5 is a top view of a second type of storage slip.
Figure 6:
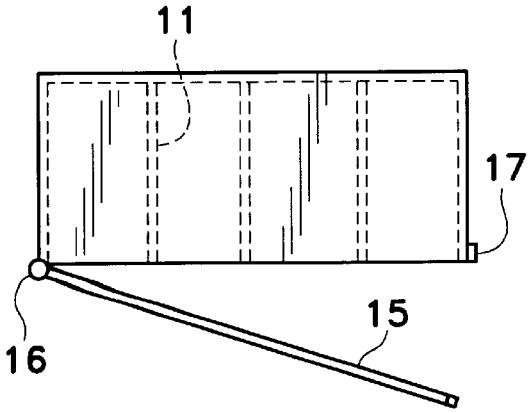
FIG. 6 is an end view of the second storage slip showing the door open.

FIGS. 5 and 6 show slip 10*b*. This slip has the same dimensions, but has a different configuration of partitions. This ability to vary the configuration of partitions makes the system versatile. In FIG. 6, the slip 10*b* has only one door 15. Although one door is preferred, it is possible to make this slip with more than one door. As before, dividers 11 and partitions 12 make up the internal structure of the slip, as before. Also, as before, latches 17 secure the lid closed.

One can keep many slips, as discussed below. When the user desires to go fishing, the user can choose two slips that contain the equipment the user wants for that style of fishing. The user can use two slips in the style of slip 10*a,* two slips like 10*b* or one of each. Moreover, the user can adjust the partitions to come up with any reasonable configuration and combination of slips.

Figure 7:
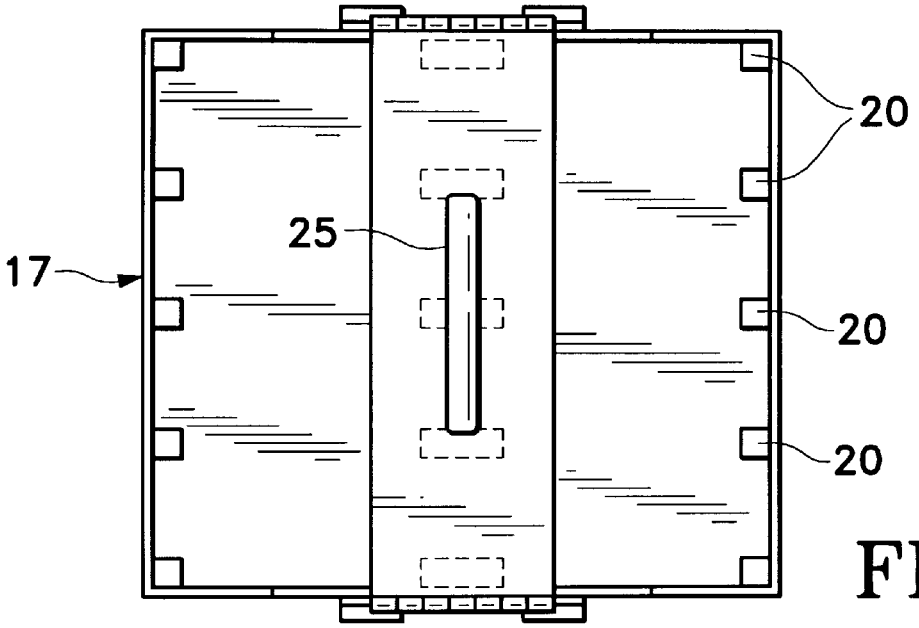
FIG. 7 is a top view of the carrying case.

To enable users to keep many pre-loaded slips, the slips are held in a carrying case 18 that is shown in FIGS. 7–11. The carrying case has an open upper portion that has a solid bottom 19. A number of ribs 20 are provided to accept and hold slips. See, e.g., FIG. 11. The case shown in FIG. 7 is designed to hold 16 slips (two per slot. To hold the slips in place, a hinged cover plate 21 is used. The cover plate has latches 22 on the front of the case 18 as shown. A hinge 23*a* connects the front of the cover 21*a* to the top 21*b* of the cover 21. Hinge 23*b* attaches the top 21*b* of the cover 21 to the back 21*c* of the cover. See, e.g., FIG. 9.

Figure 8:
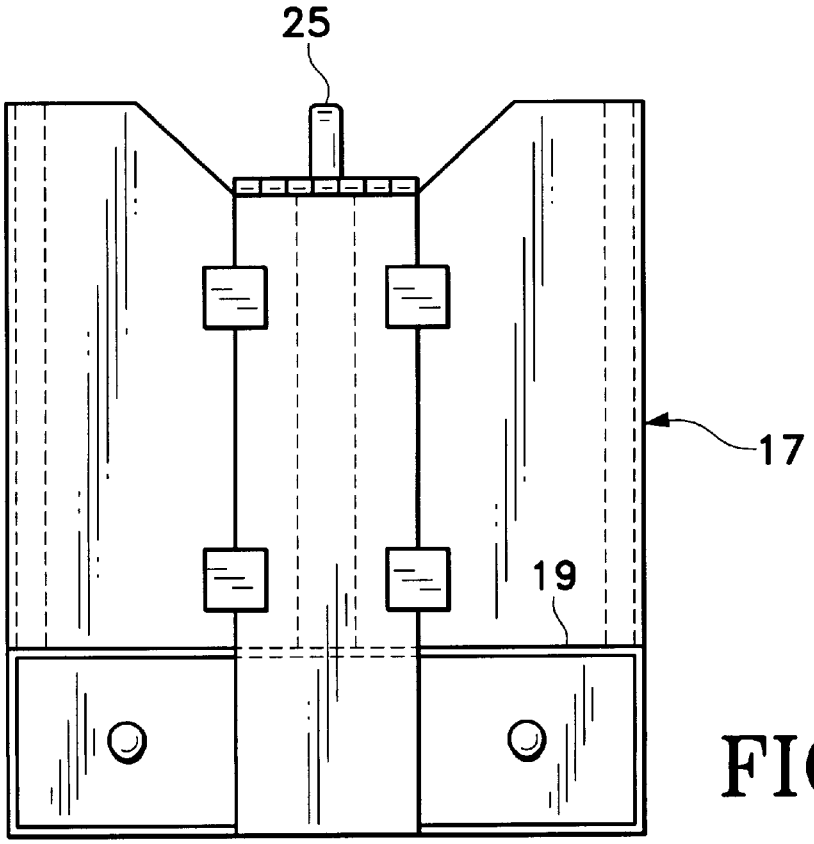
FIG. 8 is a front view of the carrying case, in the closed position.
Figure 9:
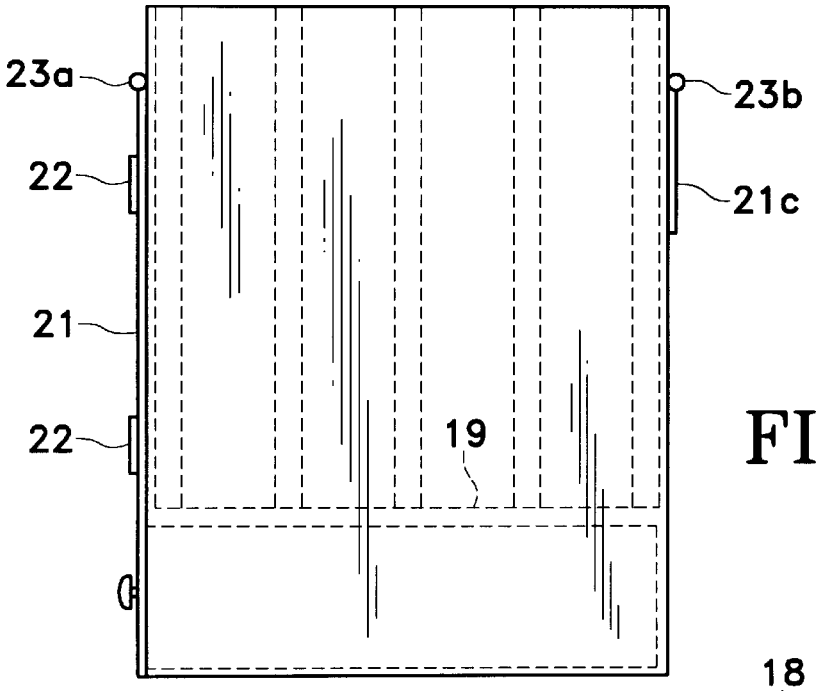
FIG. 9 is a right-side elevation of the storage case.
Figure 10:
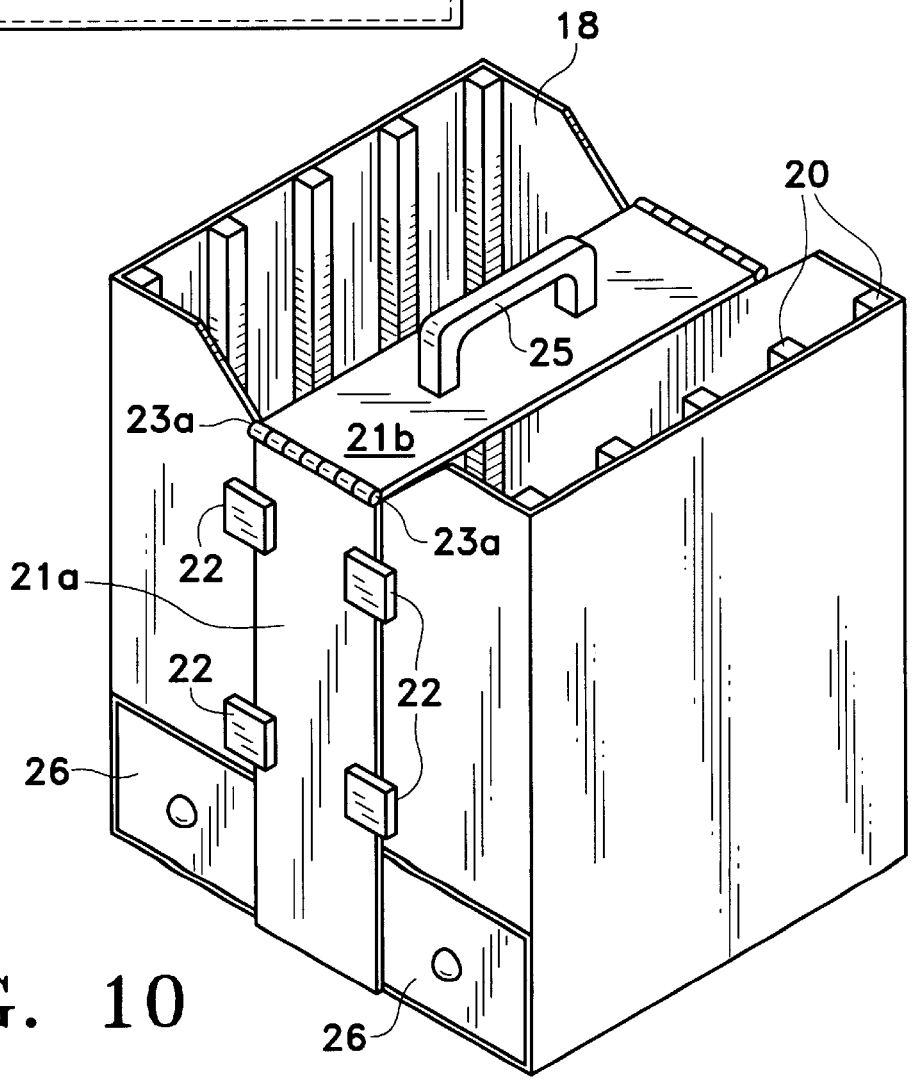
FIG. 10 is a perspective view of the storage case.
Figure 11:
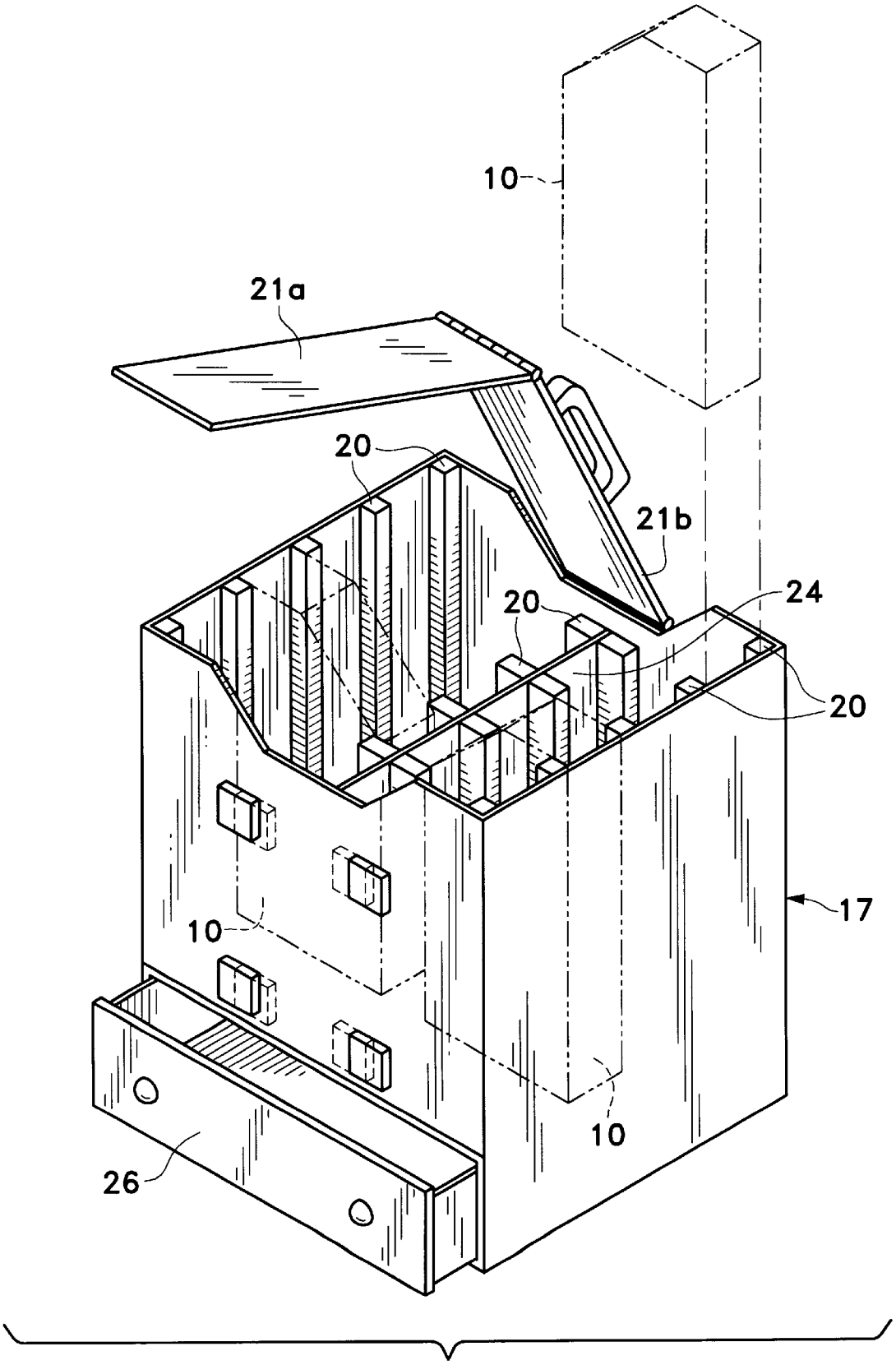
FIG. 11 is a perspective view of the storage case in the open position, showing the drawer open and a slip in alignment for storage.

For the convenience of the user, a small storage drawer 26 is placed at the bottom of the storage box as shown. FIG. 8 shows a front view of the case. FIG. 9 shows a side view of the case 18 and FIG. 10 shows a perspective view of the closed case 18 with no slips installed. FIG. 11 shows the storage case 18 open, with the drawer 26 open and two slips 10 in place. A third slip 10 is in position to be installed as shown.

It is also possible to keep more than one case, depending on the style of fishing. For example, one can have a case used for salt-water fishing, one for fresh water fishing and one for fly-fishing. Each case has a number of slips loaded with the particular type of fishing ready to use. At the start of a fishing trip, the user selects the case suited for the type of fishing planned for the trip and the user is ready to go. Moreover, the user can place one or two slips of a different type of fishing in each case to be ready for an alternate style of fishing, without having to carry a lot of extra equipment.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A fishing equipment storage system comprising:

a) a vest, having a front, having a length, and a back, the front of said vest having a right side and a left side;

b) at least one pocket, formed in the front of said vest, said one pocket having a top, said top being slanted along one corner thereof, said at least one pocket having a closable opening along a length thereof; and c) at least one storage container, having an interior compartment and being sized to fit within said one pocket of said vest, said storage container being generally rectangular, having two long sides and two short sides, said storage container having at least one corner cut at an angle with respect to one long side of the storage container.

2. The fishing equipment storage system of claim 1 further comprising a carrying case, to hold said storage container.

3. The fishing equipment storage system of claim 1 further comprising a means for holding a fishing rod, secured to said vest.

4. The fishing equipment storage system of claim 3 wherein the means for holding a fishing rod comprise:

a) a first loop, secured to the front of said vest; and b) a second loop, secured to the front of said vest, such that said second loop is positioned above, and in a vertical alignment with, said first loop.

5. The fishing equipment storage system of claim 4 wherein said second loop comprises:

a) a first portion, extending out from said vest;

b) a second portion, also extending out from said vest; and c) a means for securing said first portion to said second portion, thereby forming a closed loop.

6. The fishing equipment storage system of claim 5 wherein the means for securing said first portion to said second portion included a hook and loop fastener.

7. A fishing equipment storage system comprising:

a) a vest, having a front, having a length, and a back, the front of said vest having a right side and a left side;

b) two pockets, formed in the front of said vest, each pocket having a top, said top being slanted along one corner thereof, said at least one pocket having a closable opening along a length thereof; and c) a plurality of storage containers, each storage container having an interior compartment and being sized to fit within one of said pockets of said vest, said storage container being generally rectangular, having two long sides and two short sides, each of said plurality of storage containers having at least one corner cut at an angle with respect to one long side of each of the plurality of storage containers.

8. The fishing equipment storage system of claim 7 further comprising a storage case to hold said plurality of storage containers when said plurality of storage containers are not in the pockets of said vest.

9. The fishing equipment storage system of claim 8 wherein said storage case comprises:

a) a base;

b) a pair of opposed side walls, extending upwardly from said base;

c) a front wall, extending upwardly from said base;

d) a rear wall extending upwardly from said base;

e) an open interior;

f) a plurality of slots, formed in said pair of opposed side walls to receive said plurality of storage containers; and g) a means for securing said plurality of storage containers in said storage case.

10. The fishing equipment storage system of claim 9 wherein said means for securing said plurality of storage containers includes a top flap, wherein said top flap is removably installed above said plurality of storage containers.

11. The fishing equipment storage system of claim 9 further comprising:

a) a center partition, fixedly installed within said open interior, thereby dividing said open interior into two equal parts;

b) a plurality of slots, formed in said center partition and being aligned with said plurality of slots in said pair of opposed side walls, said plurality of slots being sized to received said plurality of storage containers.

12. The fishing equipment storage system of claim 7 wherein said plurality of storage containers included a first type, said first type including:

a) one door, hingably attached to said first type; and a plurality of movable partitions, formed in said first type of storage container.

13. The fishing equipment storage system of claim 7 wherein said plurality of storage containers includes a second type, said second type including:

a) two doors, hingably attached to said second type and b) a plurality of movable partitions, formed in said second type of storage container.

14. The fishing equipment storage system of claim 13 wherein said second type of storage container has a front and a back, and further wherein one of said two doors is hingably attached to said front of said second type of storage container and the second of two doors is attached to the back of said second type of storage container.

15. The fishing equipment storage system of claim 9 further including at least one storage drawer, operable attached to said storage case.

16. The fishing equipment storage system of claim 9 wherein the means for securing said plurality of storage containers in said storage case includes a means for locking said the means for securing said plurality of storage containers.

17. A method of storing and using fishing equipment comprising the steps of:

a) placing a quantity of fishing equipment into a plurality of storage containers, providing each of said plurality of storage containers with an interior compartment and sizing the containers to fit within a pocket of a vest, forming each of said plurality of storage containers with two long sides and two short sides in a generally rectangular configuration, cutting at least one corner of each of said plurality of storage containers at an angle with respect to one long side of each of the plurality of storage containers;

b) storing said plurality of storage containers in a storage case;

c) selecting at least one storage container from said storage case;

d) placing said one storage container into said pocket of said vest, providing said vest with a front, a length, and a back, providing the front of said vest with a right side and a left side and at least one pocket formed in the front of said vest, said said pocket having a top, slanting said top of said pocket along one side thereof providing a closable opening along one side of said pocket; and e) wearing said vest while fishing.

18. The method of claim 17 further comprising the steps of:

a) removing a storage container from said pocket of said vest;

b) removing desired fishing equipment from said storage container; and c) replacing said storage container in said pocket of said vest.

19. The method of claim 18 wherein prior to the step of removing one storage container from said pocket of said vest, the step of securing a fishing rod, having a bottom and a reel and an upper rod portion, to said vest is performed.

20. The method of claim 19 wherein the step of securing a fishing rod to said vest includes the steps of:

a) placing the bottom of said fishing rod into a first loop, secured to said vest, until the reel engages said first loop; and b) securing said upper rod portion to a second loop on said vest.

* * * * *